US006429787B1

(12) United States Patent
Pyne

(10) Patent No.: US 6,429,787 B1
(45) Date of Patent: Aug. 6, 2002

(54) ROTATING RF SYSTEM

(75) Inventor: John W. Pyne, Erie, CO (US)

(73) Assignee: Crosslink, Inc., Boulder, CO (US)

( * ) Notice: Subject to any disclaimer, the term of this patent is extended or adjusted under 35 U.S.C. 154(b) by 0 days.

(21) Appl. No.: 09/394,126

(22) Filed: Sep. 10, 1999

(51) Int. Cl.[7] ..... G08C 19/06; G08C 19/12

(52) U.S. Cl. ..... 340/870.31; 340/854.4; 367/82; 343/720; 343/700 MS

(58) Field of Search ..... 340/870.31, 854.4; 367/82; 343/720, 719, 700 MS

(56) References Cited

U.S. PATENT DOCUMENTS 5,028,930 A * 7/1991 Evans ..... 342/373
5,382,959 A * 1/1995 Pett et al. ..... 343/700 MS
5,769,503 A * 6/1998 Stolarczyk et al. ..... 299/1.2

* cited by examiner

*Primary Examiner*—Timothy Edwards
(74) *Attorney, Agent, or Firm*—Patton Boggs LLP

(57) ABSTRACT

A system for transmitting data between a rotating system and a stationary system. This system has a patch antenna affixed to the surface of a rotating body. A transmitter splits an RF signal into n identical RF signals. The n RF signals are phase shifted to have phases that are 360 divided by n degrees apart. The RF signals are then sequentially applied to the n patch antennas which broadcast the RF signals. A stationary receive antenna receives broadcast RF signals from one of the n patch antennas at a time. As a first antenna rotates out of range of the receive antenna, second antenna rotates into range. The phase shift between the RF signals broadcast between from the first and second antenna assures that data is not lost as the rotation occurs.

15 Claims, 7 Drawing Sheets

ROTATING RF SYSTEM

FIELD OF THE INVENTION

This invention relates to a system for transmitting data between a rotating body and a stationary device. More particularly, this invention relates to an RF system that is used to transmit data between a drill casing and a stationary receiver. Still more particularly, this invention relates to n phased patch antennas affixed around an outer surface of the rotating body and a transmitter that sequentially applies n RF signals, where n is an integer greater than 1, that are phased 360°/n apart to the antennas.

Problem

It is a problem in the well drilling arts to receive hole data from the drill and casing as the drill is being operated. One must understand drilling operations to understand the problems of collecting the data. In order to drill a well, a platform is constructed over a desired location. The platform has a motor which turns a casing that is connected to a drill bit. As the drill bit is turned, the casing is forced downward. The casing is hollow and liquid is pumped into the casing to cool the drill bit and to remove excess material from the hole. Once a section of casing has been extended into the hole, an additional section of casing is affixed to a top end of a prior section of casing to lengthen of the casing.

Sensors are typically attached to the casing and to the drill bit to measure hole and equipment characteristics. It is a problem to retrieve the data from the sensors. Data must be received quickly during the drilling process to detect possible problems so that drilling operations can be halted or altered to eliminate the problem. Therefore, it is desireable to receive the data as soon as it is collected.

A first problem that is particular to retrieving data from a rotating drill casing and applies generally to rotating objects is the rotation of the casing. The rotation of the casing makes it impossible to use a physical connection such as a data line connected to the casing to retrieve data. The data lines would wrap around the casing as the casing rotates.

In order to solve this problem, Radio Frequency (RF) signals can be used to transmit data between a rotating body, such as the well casing, and a stationary object. However, some particular problems arise from using RF signals. One problem is affixing antenna to the rotating object. The antennas must rotate with the object. The rotation of the antenna causes the antennas to rotate out of range of one stationary antenna. This can cause data to be missed as RF signals from the rotating antenna are not received by the stationary antenna. Furthermore, the stationary antenna must be proximate the rotating object to maximize the range that the antenna can receive signals during a rotation. This is a problem on a drilling platform because space on the platform is limited and it is likely that the heavy equipment on the platform could damage a stationary antenna mounted on the platform during drilling operations.

There is a need in the art for an RF system that can reliably transmit data between a rotating body and a stationary RF system. Furthermore, there is a particular need in the drilling art for an RF system that can increase the distance between RF system on a rotating drill casing and a receive antenna.

Solution

The above and other problems are solved and an advance in the art is made by the provision of a rotating RF system.

The rotating RF system reduces the amount of data that is lost as an antenna on a rotating body rotates out of range of a stationary antenna. The rotating RF system also allows the stationary antenna to be placed further away from the rotating body. This allows the stationary antenna to be place off a drilling platform in a preferred exemplary embodiment.

The rotating RF system has n patch antennas affixed around the outer surface of a rotating body, such as a drill casing. In a preferred embodiment, each of the n patch antennas is horizontally phased which allows each antenna to broadcast RF signals outward from the rotating body in a direction substantially perpendicular to the outer surface of the rotating body. By directing the broadcast RF signals in a focused direction, the stationary antenna may be moved farther away from the routing body, since the stationary antenna must remain in communication with one of the n patch antennas for only a limited amount of the rotation.

RF signals transmitted by the patch antennas are generated in the following manner to reduce the amount of data that is lost. A transmitter in the rotating body generates an RF signal with encoded data. The RF signal is then applied to circuitry that splits the RF signal into n identical RF signals. The n RF signals are then phase shifted to create n RF signals that each are phased three hundred and sixty divided by n degrees apart. The first RF signal is phase shifted by zero degrees and the nth RF signal is phase shifted by 360° minus 380°/n degrees.

The n RF signals are then sequentially applied to the n patch antennas. The following is an example of sequentially applying the n RF signals to the n patch antennas. The first RF signal having a phase shift of zero degrees is applied to a first antenna. A second RF signal having a phase shift of three hundred and sixty divided by n is applied to a second patch antenna which affixed to the outer surface of the rotating body in a position that allows the second antenna to come into range of the stationary antenna as the first antenna rotates out of range of the stationary antenna. The remaining n−2 signals are similarly applied to the remaining n−2 patch antennas.

As the rotating body rotates, the one patch antenna is broadcasting towards the stationary antenna. As the broadcasting antenna moves out of range, a second antenna rotates into range and begins broadcasting to the stationary antenna. The RF signals from the second antenna are phased shift 360°/n from the RF signals from the first antenna. This assures that a redundant signal is provided as the transmitting patch antennas change this assures that data is not lost during the change.

In a preferred embodiment of the present invention, the rotating RF system also has at least one receive antenna connected to the outer surface of the rotating body to allow a stationery transmit antenna to transmit RF signals to the rotating body.

DESCRIPTION OF THE DRAWINGS

The above and other features of a rotating RF system of the present invention is described in the below Detailed Description and the following drawings.

DETAILED DESCRIPTION

Figure 1:
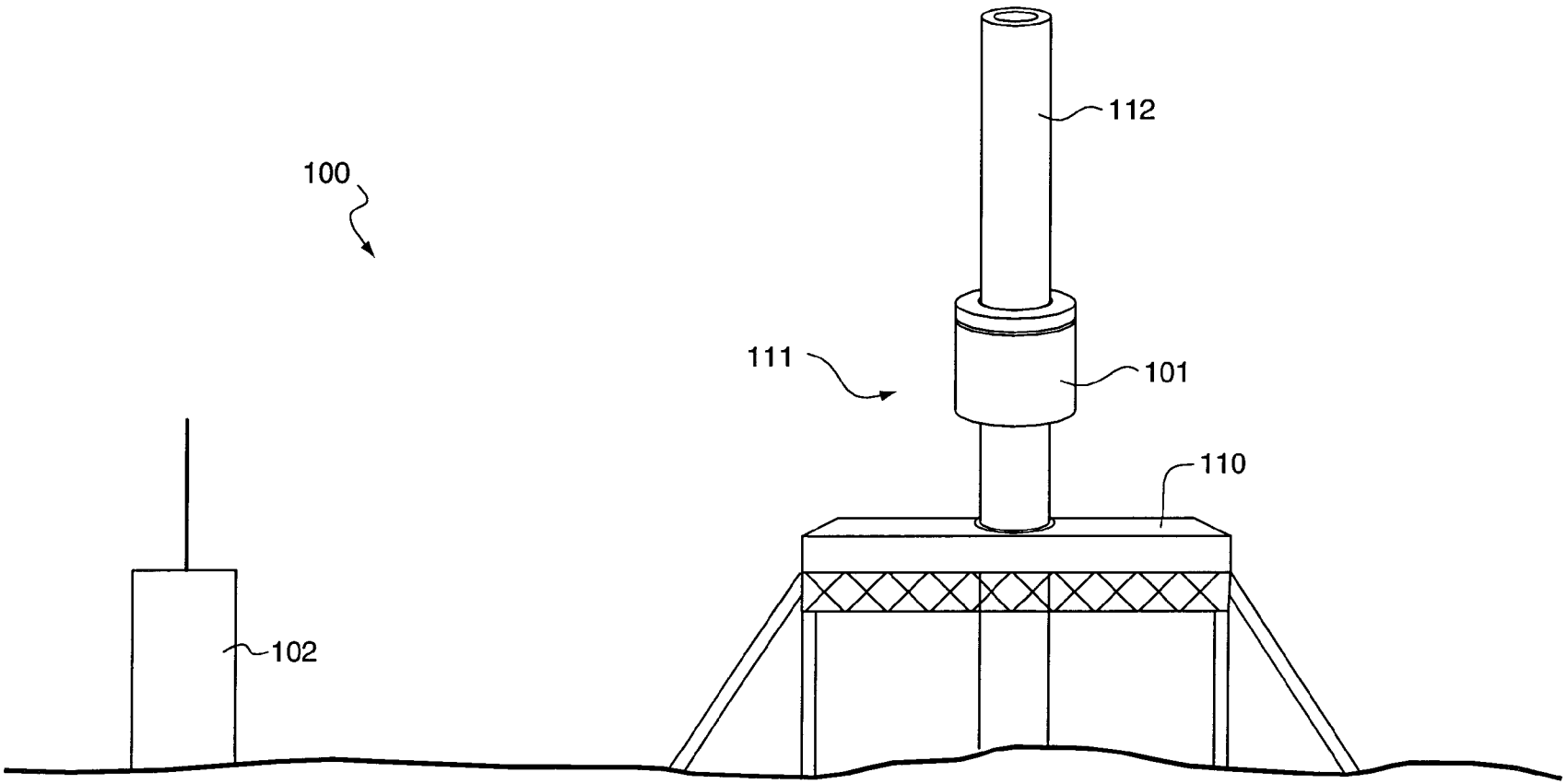
FIG. 1 illustrating a well drilling platform incorporating the rotating RF system of the present invention.

FIG. 1 illustrates a well drilling platform 110 which incorporates RF system 100 of the present invention. Although, it should be apparent to those skilled in the RF transceiver arts that the rotating RF system 100 can be incorporated in other environment having a rotating body. Well drilling platform 110 has a drilling mechanism 111 which rotates a drill casing 112 and forces drill casing 112 downwards during drilling. Drill casing 112 is comprised of several casing sections (not shown) with a drill bit (not shown) connected to a bottom end. Sensors (not shown) may be connected to inner and outer surfaces of the casing 112 as well as the drill bit to monitor hole and equipment properties. RF system 100 is used to transmit the data collected from the sensors to monitoring system 102. Rotating RF system 101 is a transceiver system that transmits RF signals from n patch antenna as a body is rotating. At an given time, monitoring system 102 is only receiving RF signals from one of n patch antennas. Monitoring system 102 is a RF transceiver device that can receive RF signals and process the signals to decode digital data embedded in the RF signals.

Rotating RF system 101 reduces the space needed for antennas by affixing n patch antenna around an outer surface of casing 112. Each patch antenna is horizontally phased to cause the antennas to broadcast RF signals in a direction substantially perpendicular to the outer surface of casing 112. This directs the signals to radiate outward from casing 112 in a focused direction. The receive antenna of monitoring system 102 may be moved away from casing 112. In the preferred embodiment, the receive antenna of monitoring system 102 is up to three hundred feet away from rotating RF system 101. The configuration of the patch antennas and the RF signals applied to the antennas, as described below, allow the receive antenna to be at a distance from rotating RF system 101.

Figure 2:
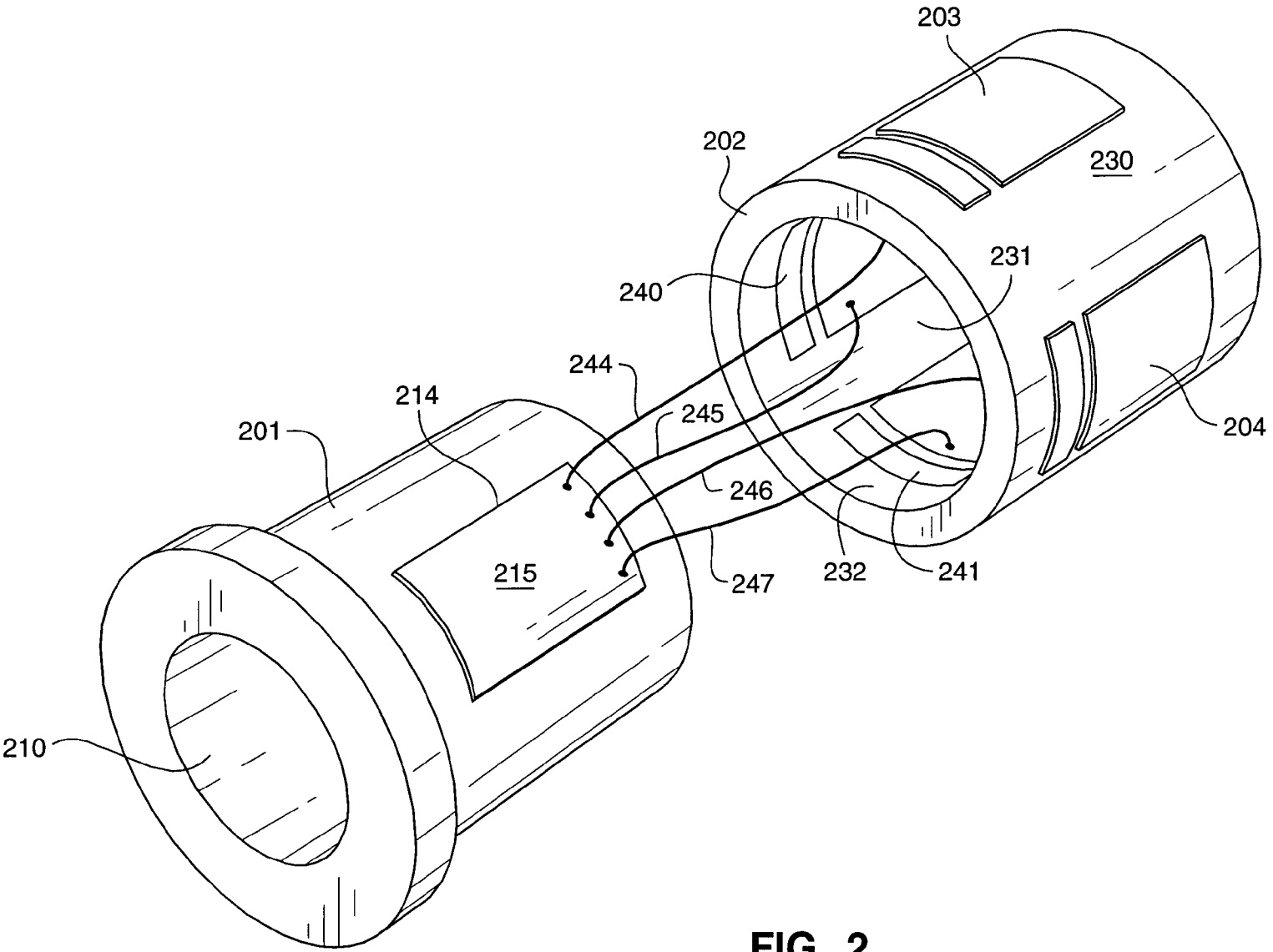
FIG. 2 illustrating a first exploded view of a preferred exemplary rotating RF system that can be affixed to a rotating body such as a drill casing.
Figure 3:
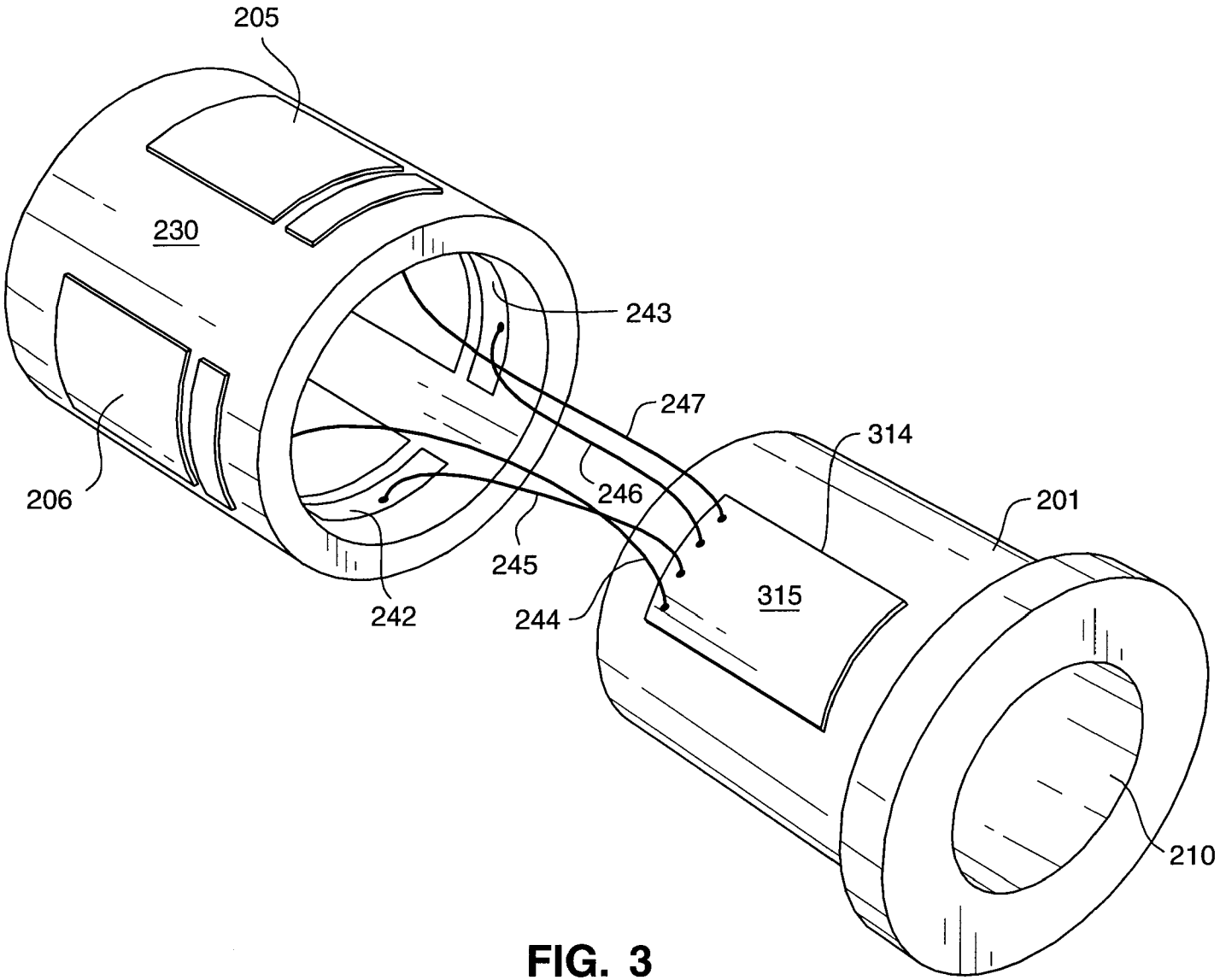
FIG. 3 illustrating a second exploded view of a preferred exemplary rotating RF system.

FIGS. 2 and 3 illustrate exploded views of rotating RF system 101 from opposite directions. Rotating RF system 101 has two components a casing assembly 201 and an antenna assembly 202. Although two separate assemblies are described, one skilled in the art will recognize that assemblies 201 and 202 can be combine into one assembly or include multiple assemblies.

Casing assembly 201 affixes rotating RF system 101 to a rotating body, such as casing 112. Casing 112 fits through opening 210 of casing assembly 201. In a preferred embodiment, opening 210 is substantially circular to allow drill casing 112 to fit through opening 210. One skilled in the arts will appreciate that opening 210 can be of any shape and proportion allows casing 212 to fit in opening 210. Casing assembly 201 may be any shape and is substantially cylindrical in the preferred embodiment to conserve space on platform 110.

Transmitter 215 affixes to casing assembly 201. Transmitter 215 encodes data received by transmitter 215 into RF signals and generates the RF signals applied to n patch antennas 203–206. In the preferred embodiment, transmitter 215 is received into slot 214 of casing assembly 201. Slot 214 is formed to securely hold transmitter 215 inside slot 214. In a preferred embodiment, transmitter 215 does not protrude from slot 214 above outer surface 212 of casing assembly 201. Transmitter 215 may be secured in slot by a nut and bolt assembly, welds or any other method of affixing circuitry to a body.

Receiver 315, illustrated in FIG. 3, also affixes to casing assembly 201. Receiver 315 decodes data from RF signals received rotating RF system 201. In the preferred embodiment, receiver 315 is received into slot 314 of casing assembly 201. Slot 314 is to formed to securely hold receiver 315 inside slot 314. In a preferred embodiment, receiver 315 does not protrude from slot 314 above outer surface 212 of casing assembly 201. Receiver 315 may be secured in slot by a nut and bolt assembly, welds or any other method of affixing circuitry to a body.

N patch antennas 203–206 are affixed around outer surface 230 of antenna assembly 202. In a preferred embodiment, there are four patch antennas 203–206. One skilled in the art will appreciate that any number of patch antennas can be used in the present invention. Patch antennas 203–206 are affixed to outer surface 2030 substantially parallel to each other around the circumference of antenna assembly 202. Any method of affixing patch antennas to antenna assembly 202 may be used.

Each patch antenna 203–206 is connected to transmitter 215 via paths 207–210. Antennas 203–206 are inserted into slots (not shown) in outer surface 230. The slots are recessed into outer surface 230 to allow the antennas to rest inside slots without protruding out of the slots past outer surface 230. Each antenna 203–206 may have a cover that prevents damage during operation of the rotating body, such as casing 112. Antennas 203–206 are horizontally phased. The horizontal phase of antennas 203–206 causes antennas 203–206 to broadcast RF signals outwards in a direction that is substantially perpendicular to the outer surface 230. Furthermore, antennas 203–206 may be curved to conform to outer surface 230 in a preferred embodiment.

Antenna assembly 202 is substantially cylindrical in a preferred embodiment. Although antenna assembly 202 can be any geometric shape. An opening 231 through antenna assembly 202 receives casing assembly 201. Opening 231 is substantially cylindrical in a preferred embodiment. However, one skilled in the art will recognize that the only requirement of opening 231 is that casing assembly 201 fits inside opening 231. Inner surface 232 inside opening 231 affixes to casing assembly 201 in any method desired by those skilled in the art. It left to those skilled in the art to provide a suitable attaching device.

It is also possible to design rotating RF system 101 with an RF receiving system, in which case, RF receiving antennas 204–243 are affixed to antenna assembly 202 in a manner similar to the manner described for antennas 203–206. Receive antennas 204–243 are connected to receiver 315 via paths 244–247.

The concept of the present invention is to broadcast RF signals from one antenna 203–206 at a time to an RF receive antenna as antennas 203–206 rotate. N RF signals are sequentially applied to the antennas 203–206. Each of the RF signals is phase shifted by 360°/n from the RF signal that is applied to the antenna that rotates into range of the receive antenna just prior to the current antenna. This allows the receive antennas to receive redundant signals as one antenna rotates out of range while a subsequent antenna rotates into range.

The following is an example of how RF signals are broadcast from rotating RF system 101 to monitoring system 102 by sequentially applying RF signals to the n RF antennas 203–236. A first RF signal having a zero degree phase is applied to antenna 203. Antenna 203 broadcast the RF signals with a zero degree phase outward to monitoring system 102. Antenna 204 is located next to antenna 203 and rotates into range of monitoring system 102 as antenna 203 rotates out of range of monitoring system 102. A second signal phase shifted by 360°/n is applied to antenna 204. This operation is repeated for each subsequent antenna. Ideally, the signal transfer rate is equal so that as one antenna rotates out of range the phase shifted signal from the next antenna transmit the next piece of data. However, some overlap is expected. The phase shift reduces the amount of data lost due to an antenna rotating out of range. Furthermore, since the RF signals are focused in there direction the receive antenna may be moved farther away from antenna 203–206. In the preferred embodiment, the receive antenna for monitoring system 102 may be up to three hundred feet away.

Figure 4:
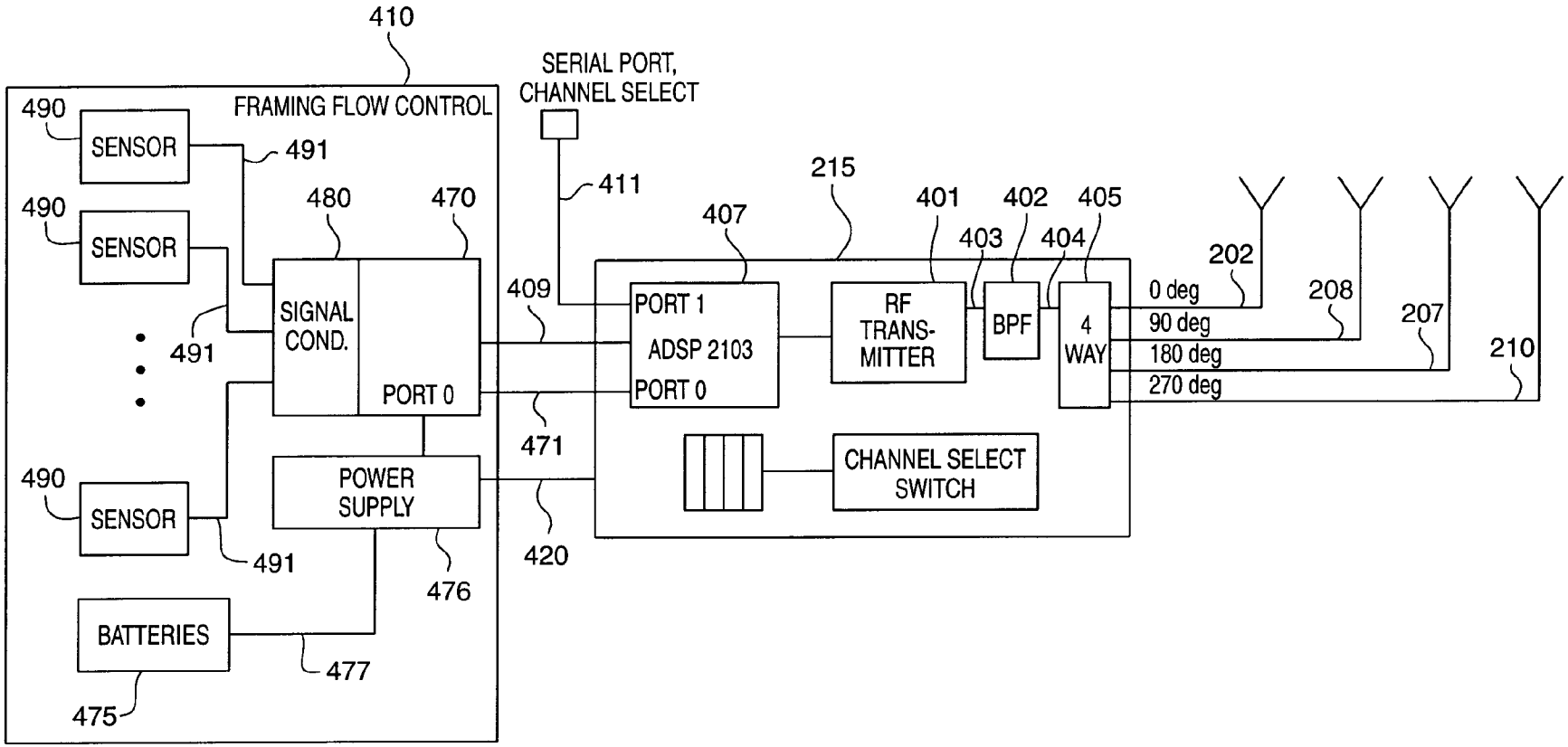
FIG. 4 illustrating circuitry inside a transmitter in a preferred exemplary rotating RF system.

FIG. 4 illustrates a block diagram of the circuitry of transmitter 215 needed to generate the phased RF signals applied to antennas 203–206. Transmitter 215 receives power via path 420. Transmitter 215 has an RF transmitter 401 which generates RF signals in a desired frequency bend such as the ISM 902–928 MHZ in a preferred embodiment. One example of transmitter 401 is a FSK Transmitter 920023 manufactured by CrossLink Inc. of Boulder, Colo.

The RF signals are applied to a band pass filter 402 via path 403 to eliminate noise signals outside the desired frequency band. One example of a band pass filter is a TKS2617CT-ND manufactured by TOKO of Japan used in the preferred embodiment. The RF signals are then applied to an N-way splitter/modulator 405 via path 404. N-way splitter/modulator 405 splits the RF signal into n separate and identical RF signals. The n identical RF signals are then phase shifted so that the n RF signals are each phase shifted 360°/n apart starting from a first RF signal having a zero degree phase shift. One example of a n-way splitter/modulator is a 920073 manufactured by CrossLink Inc. of Boulder, Colo. used in the preferred embodiment to generate four phase shifted RF signals. Each of the n signals is then applied to one of antennas 203–206 via paths 207–210.

Transmitter 215 may also include an Analog to Digital (A/D) signal processor 407 which receives data from an outside source. The A/D signal processor 407 converts digital data received from a primary processing system 410 into analog signals encoding data from the digital signals. A/D signal processors are conventional and well known in the art. A/D signals processor 407 receives data from primary processing system 410 via path 409 and transmits analog signals to transmitter 401 via path 411. One skilled in the art will recognize that the circuitry described above could be combined in any combination to provide the functions described.

In a preferred embodiment, primary processing system 410 is a data acquisition system that receives data from sensors in a drill bit and in drill casing 112. However, primary processing system 410 may be any processing system depending on the system in which rotating RF system 101 is used. In the preferred embodiment, sensors 490 transmit signals to signal conditioner 480 via paths 491. Signal conditioner 480 receives the signals, removes noise from the signals and generates digital data based upon the signals received from sensors 490.

Processor 470 receives the signals and generates data frames in a protocol used for communication between processor in RF system 100. One common processor is a ADSP-2103-BP40 manufactured by Analog Devices Inc. The data frames are then transmitted to transmitter 215 via path 471.

Figure 5:
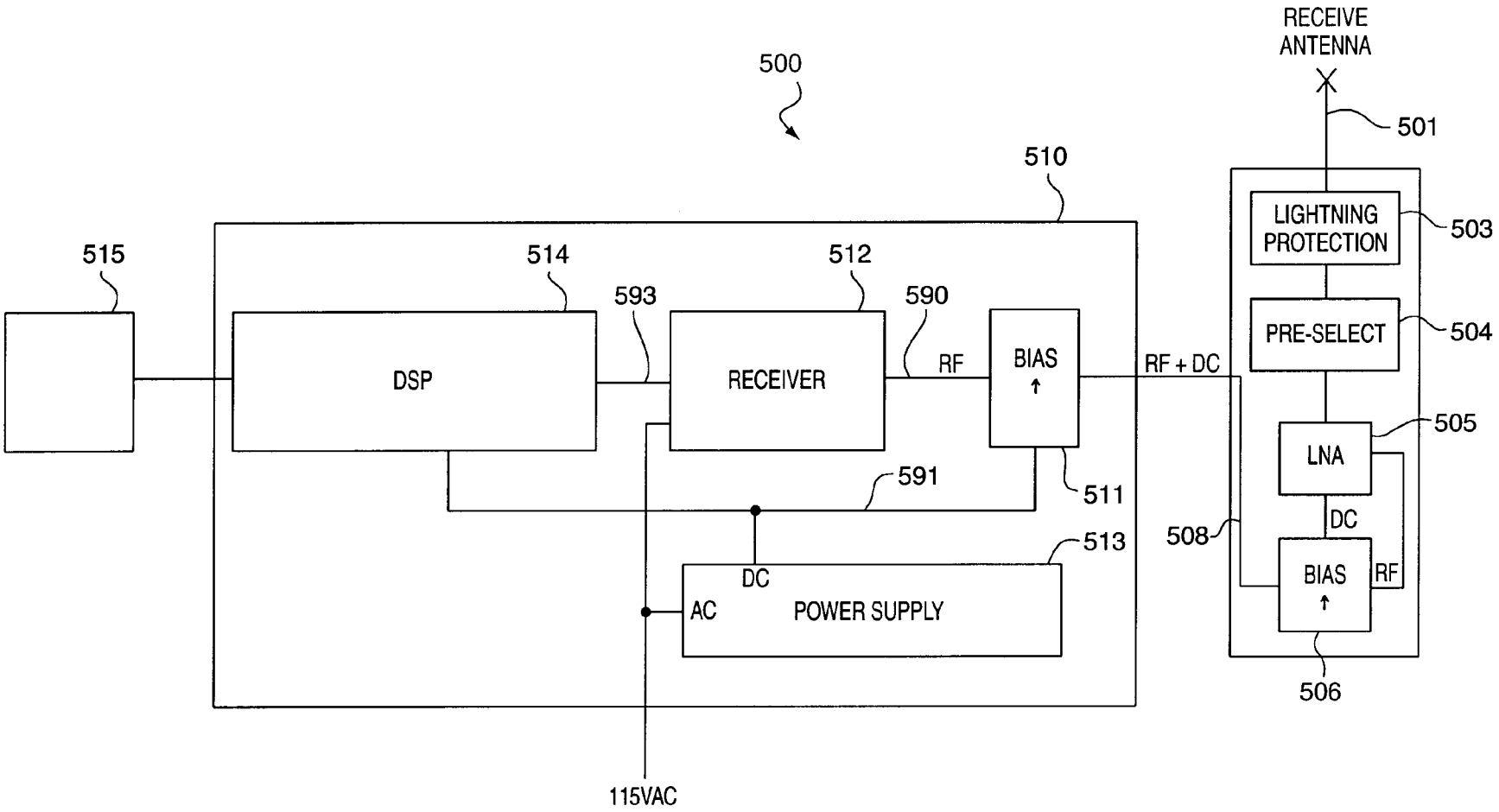
FIG. 5 illustrating circuitry for receiving RF signals inside a stationary receiving station.

Power for primary processing system 410 and transmitter 215 is provided by batteries 475 and power supply 476 via path 477. Power supply 476 applies a current to both processing system 410 and transmitter 215. FIG. 5 illustrates an RF receiving system 500 in monitoring system 102. A receive antenna 501 receives the RF signals broadcast by the antenna 203–206 that is currently broadcasting signals towards RF monitoring system 102. Receive antenna 501 is a conventional antenna having a proper gain to receive signals in the desired frequency band.

Receive antenna 501 is connected to lightening protection circuitry 503 which prevents receiving system 500 from being damaged by overpower generated by a lightning strike. RF signals received by antenna 501 are applied to preselector 504. Preselector 504 is circuitry that increases the sensitivity of receiver system 500.

The RF signals are then applied to LNA circuitry 505. One example of LNA circuitry 505 is ZHL-0812 HLN. LNA circuitry 505 filters noise out of the RF signals and converts the noise to a DC current. The DC current and the RF signals are applied by the LNA circuitry to a Bias T circuit 506. The Bias T circuit 506 allows the RF signals and DC voltage to share a common conductor such as coaxial cable. The Bias T circuit then applies the DC current and RF signals to receiver 510 via path 508.

Bias T circuitry 511 receives the DC current and RF signals in receiver 510. Bias T circuitry 511 splits the received signals into a DC current and RF signals. The RF signals are then applied to RF receiving circuitry 512 via path 590 and the DC current is applied to power supply 513 via path 591. RF receiving circuitry 512 converts the RF signals into digital data. The digital data is then transmitted to a processor 514 via path 593. Processor 514 generates data frames from the digital data. The data frames are then transmitted to secondary processing system 515. Secondary processing system 515 then uses the data to perform operations. In the preferred exemplary embodiment, secondary processing system 515 is a computer system that executes software applications that monitor drill and hole conditions during drilling operations.

Figure 6:
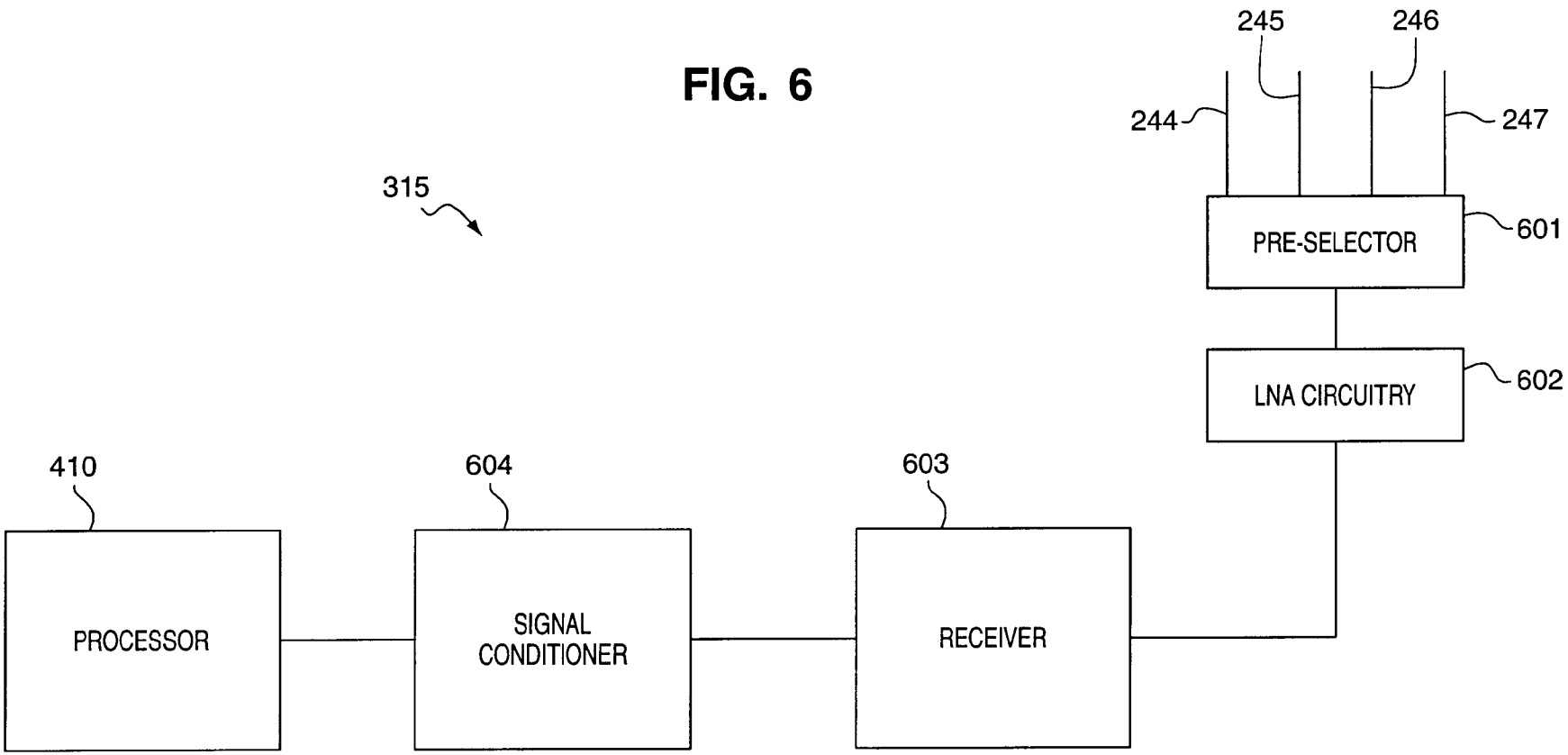
FIG. 6 illustrating circuitry inside a rotating RF signal for receiving RF signals.

FIG. 6 illustrates RF receiving system 315 in rotating RF system 101. Receiving system 315 is connected to receive antennas 204–243 on antenna assembly 202 via paths 244–247. RF receiving system 315 can be used to dynamically reprogram either transmitter 215 or primary processing system 410.

Paths 244–247 are connected to preselector circuitry 601 which is an amplifier which increase the sensitivity of receiver 315. The RF signals from preselector circuitry 601 a applied to LNA circuitry 602. LNA circuitry 602 amplifies the received RF signals. The received RF signals are then applied to receiver 603 which selects the desired frequencies from the received RF signals. The desired RF signals are applied to signal conditioner 604 which removes noise in the RF signals in the desired frequencies and converts the RF signals to digital data. Processor 410 receives the digital data from signal conditioner 604. Processor then transmits the data to transmitter 215 or primary processor 410 via paths (not shown). The digital data contains instructions for reprogramming transmitter 215 and processor 410.

Figure 7:
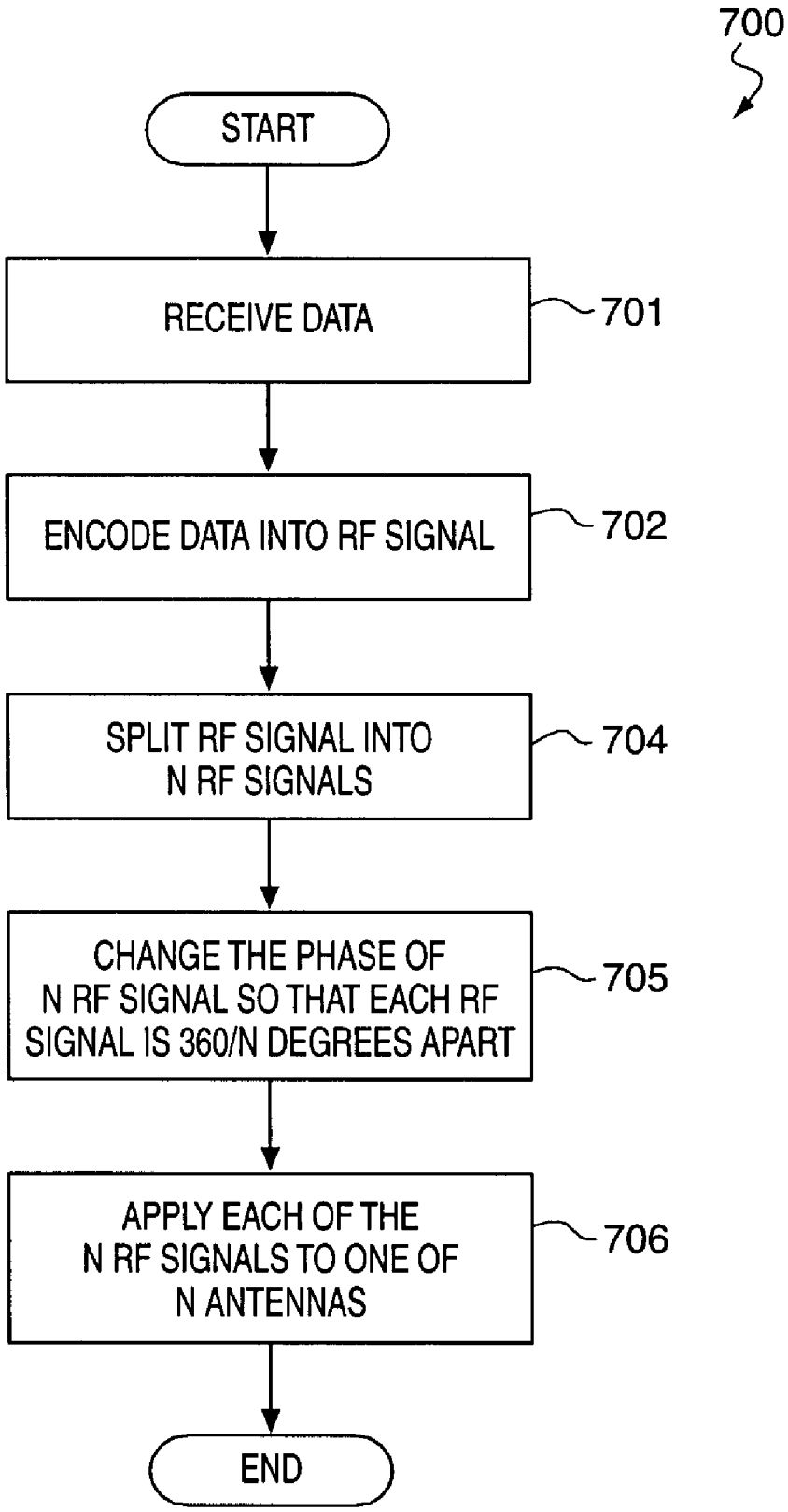
FIG. 7 illustrating a flow chart of a process for transmitting RF signals from the rotating RF system.

FIG. 7 illustrates a flow diagram of a process 700 performed by transmitter 215 to transmit data from a rotating body such as drill casing 112. Process 700 begins with transmitter 215 receiving digital data from a primary processing system 410. The data is then encoded recessed into RF signals in step 703. The RF signals are then split into n identical RF signals in step 704. The n identical RF signals are phase shifted in step 705 so that each of the n RF signals have phases that are separated 360°/n starting from zero degrees.

Each of the n RF signals is then sequentially applied to one of n patch antennas on antenna assembly 202. For example, a first RF signal having a zero degree phase is applied to a first antenna which transmits the first RF signal. A second RF signal having a phase of 360°/n is applied to a second antenna next to the first antenna wherein the second antenna rotates into range of broadcasting to a stationary antenna as the first antenna rotates out of range. This process is repeated from a remainder of the n RF signals. In the preferred embodiment, the 4 RF signals sequentially applied to antennas 203–206 have phase shifts of zero degrees, 90 degrees, 180 degrees, and 270 degrees.

The above is a description of a system for transmitting data between a rotating body and a stationary system. It is envisioned that those skilled in the art can and will design alternative systems that infringe on this system as set forth in the claims below either literally or through the Doctrine of Equivalents.

What is claimed is:

1. A system for transmitting data between an RF system that is mounted on a rotating body, in the form of a drill casing, and a stationary RF system comprising:

n patch antennas that broadcast RF signals affixed to an outer surface of said rotating body around the circumference of said rotating body, where n is an integer greater than 1;

a transmitter attached to said rotating body that is connected to said n patch antennas;

circuitry in said transmitter that splits an RF signal into n identical RF signals and adjusts said n identical RF signals to be phase shifted 364°/n apart; and signal splitter circuitry that sequentially applies each of said n RF signals to a corresponding one of said n patch antennas.

2. The system of claim 1 wherein said n patch antennas are affixed substantially parallel to one another around a circumference of said rotating body.

3. The system of claim 1 comprising:

a stationary receive antenna locating located proximate said rotating body that receives RF signals from at least one of said n patch antennas at a time; and a receiver connected to said stationary receive antenna that detects said RF signals received by said stationary antenna.

4. The system of claim 1 wherein said n phase shifted RF signals are applied sequentially to said n patch antennas.

5. The system of claim 1 further comprising:

at least one receive antenna affixed to said rotating body.

6. The system of claim 1 further comprising:

a receiver in said rotating body connected to said at least one receive antenna to detect RF signals received by said at least one receive antenna.

7. The system of claim 1 wherein said n patch antennas are horizontally phased.

8. The system of claim 7 wherein RF signals transmitted from said n patch antennas are transmitted outward in a direction substantially perpendicular to said outer surface of said rotating body.

9. The system of claim 7 wherein said circuitry that applies said RF signals sequentially applies said n RF signals to said n patch antennas.

10. The system of claim 1 further comprising:

circuitry in said transmitter that generates RF signals encoded with data.

11. The system of claim 10 further comprising:

an analog-digital signal processor that receives digital data from a primary processing system and converts said digital data to analog signals and applied said analog signals to said circuitry that generates RF signals.

12. The system of claim 11 wherein said primary processing system comprises:

a digital signal processor;

a signal conditioner that receives analog inputs and generates digital signals from said analog input; and sensors that provide said analog inputs to said signal conditioner.

13. A method for transmitting signals from an RF system comprising a transmitter and n patch antennas, where n is an integer greater than 1, that are mounted on a rotating body, in the form of a drill casing, to a stationary RF system comprising the steps of:

generating an RF signal in said transmitter;

splitting said RF signal into n identical RF signals, where n is an integer greater than 1;

phase shifting said n RF signals to create RF signals having phases that are 360°/n apart; and sequentially applying said n RF signals to a corresponding one of said n patch antennas that are affixed to an outer surface of said rotating body.

14. The method of claim 13 further comprising the steps of:

receiving data from a primary processing system; and encoding said data into said RF signal in said step of generating.

15. The method of claim 14 further comprising the step of:

transmitting one of said n phase shifted RF signals at a time to said stationary RF system.

* * * * *